US008192294B2

(12) United States Patent
Lynch

(10) Patent No.: US 8,192,294 B2
(45) Date of Patent: Jun. 5, 2012

(54) FOLDING GOLF PUTTING AND CHIPPING AID

(76) Inventor: Michael Lynch, West Lothian (GB)

( * ) Notice: Subject to any disclaimer, the term of this patent is extended or adjusted under 35 U.S.C. 154(b) by 57 days.

(21) Appl. No.: 12/618,078

(22) Filed: Nov. 13, 2009

(65) Prior Publication Data

US 2011/0118041 A1 May 19, 2011

(51) Int. Cl.
*A63B 69/36* (2006.01)

(52) U.S. Cl. ..... 473/180

(58) Field of Classification Search ..... 473/180, 473/181, 195, 196, 407; 33/415, 422, 461, 33/462, 465
See application file for complete search history.

(56) References Cited

U.S. PATENT DOCUMENTS

| | | | | | |
|---|---|---|---|---|---|
| 465,664 | A | * | 12/1891 | Hogarty | 403/113 |
| 1,673,577 | A | * | 6/1928 | McGee | 403/93 |
| 2,336,894 | A | * | 12/1943 | Shannon | 473/180 |
| 2,383,866 | A | * | 8/1945 | Kling | 473/180 |
| 2,453,605 | A | * | 11/1948 | Thomas | 473/180 |
| 3,269,015 | A | * | 8/1966 | Barker | 33/27.08 |
| 3,338,579 | A | | 8/1967 | McKain | |
| 3,490,769 | A | * | 1/1970 | Torbett | 473/196 |
| 4,295,650 | A | * | 10/1981 | Keeble | 273/118 R |
| 4,809,988 | A | | 3/1989 | Hunter | |
| 5,310,187 | A | | 5/1994 | Yamaguchi et al. | |
| 5,897,439 | A | * | 4/1999 | Hohl et al. | 473/176 |
| 5,938,537 | A | | 8/1999 | Liu | |
| 6,001,033 | A | * | 12/1999 | Tucker | 473/409 |
| 6,015,352 | A | * | 1/2000 | Leopold et al. | 473/172 |
| 6,183,373 | B1 | * | 2/2001 | Falvo | 473/180 |
| 6,336,875 | B1 | * | 1/2002 | Rice | 473/407 |
| 6,823,603 | B1 | * | 11/2004 | Tindall | 33/471 |
| 6,829,837 | B2 | * | 12/2004 | Williams | 33/473 |
| 6,923,730 | B1 | | 8/2005 | Potter | |
| 7,299,559 | B2 | * | 11/2007 | Moss | 33/429 |
| 7,546,687 | B2 | * | 6/2009 | Haala | 33/415 |

FOREIGN PATENT DOCUMENTS

| | | |
|---|---|---|
| GB | 191514649 | 8/1916 |
| GB | 2073598 | 10/1981 |

* cited by examiner

*Primary Examiner* — Mark Graham
(74) *Attorney, Agent, or Firm* — Dickinson Wright PLLC

(57) ABSTRACT

A golf target apparatus for improving a golfer's technique, the apparatus comprising a plurality of hingable arms hingedly connected to a connecting member, and a bearing connecting upper and lower members of the connecting member, wherein the arms are rotatable about the bearing.

20 Claims, 3 Drawing Sheets

FOLDING GOLF PUTTING AND CHIPPING AID

FIELD OF THE INVENTION

The present invention relates to golf putting and chipping aids, and particularly those golf putting and chipping aids that incorporate means of adjustment thereof.

BACKGROUND

It is well known that children or indeed adults learning to play golf begin to play on a practice area similar to a putting green or other such location having a substantially horizontal surface where they spend time familiarizing themselves with the art of putting the ball and practicing their putting strokes and/or chipping shots.

In perfecting the novice golfers stroke/shot it is often the case that a device or devices are used in an attempt to train the novice golfers eye to focus on the desired location where it is intended that the golf ball will come to rest or provide feedback to the golfer regarding the line the ball is taking while travelling. These devices are often cumbersome and unwieldy not to mention expensive. In an attempt to overcome these deficiencies it is known to arrange a pair of golf clubs flat on the ground to form a target vee, the apex of which is placed slightly behind a hole. The golfer then has a visual aid which he can obtain feedback from that allows him to make incremental adjustments in his stroke/shot until he becomes proficient at placing the ball in the hole. However, making use of golf clubs in this way is far from ideal as for example when a person becomes increasingly confident in their putting ability they will reduce the size of the target vee by adjusting the golf clubs to form a cross or X on the ground however, in doing so the portion of the golf clubs behind the apex of the cross provide a distraction for the eye and counteract the positive effects of providing the focal point at the apex of the cross.

A further problem encountered when utilizing golf clubs in a vee or cross formation to aid in putting or chipping is that the clubs can easily be moved by accident or without the user's knowledge thereby providing an inconsistent target for the novice golfer, which is clearly detrimental to their aim.

It is an aspect of the present invention to obviate or mitigate at least one of the aforementioned problems.

SUMMARY OF THE DISCLOSURE

The specification discloses a golf target apparatus for improving a golfer's technique, comprising a plurality of hingable arms hingedly connected to a connecting member, and a bearing connecting upper and lower members of the connecting member. The arms are rotatable about the bearing. The bearing may, according to one embodiment, comprise a pin.

Per one feature of the invention, the arms are rotatable about the bearing between a closed position and an open position in which the arms and connecting member provide a target area and a focal point, and wherein the length of each arm is reducible to reduce the size of the target area.

Per another feature, each arm comprises a plurality of hingedly connected elongate members which are rotatable to reduce the size of the target area.

Per yet another feature, the apparatus comprises two arms which may be brought together for easy stowing of the apparatus.

According to a still further feature, the connecting member includes an orifice for securely housing a flagpole.

Per another feature of the invention, the connecting member is provided with a means for measuring a distance between the focal point and a golf ball.

Per yet another feature, the hinging means is capable of approximately 180 degrees of rotation.

BRIEF DESCRIPTION OF THE DRAWINGS

Embodiments of the present invention will now be described, by way of example only, with reference to the accompanying drawings in which.

WRITTEN DESCRIPTION

Figure 1:
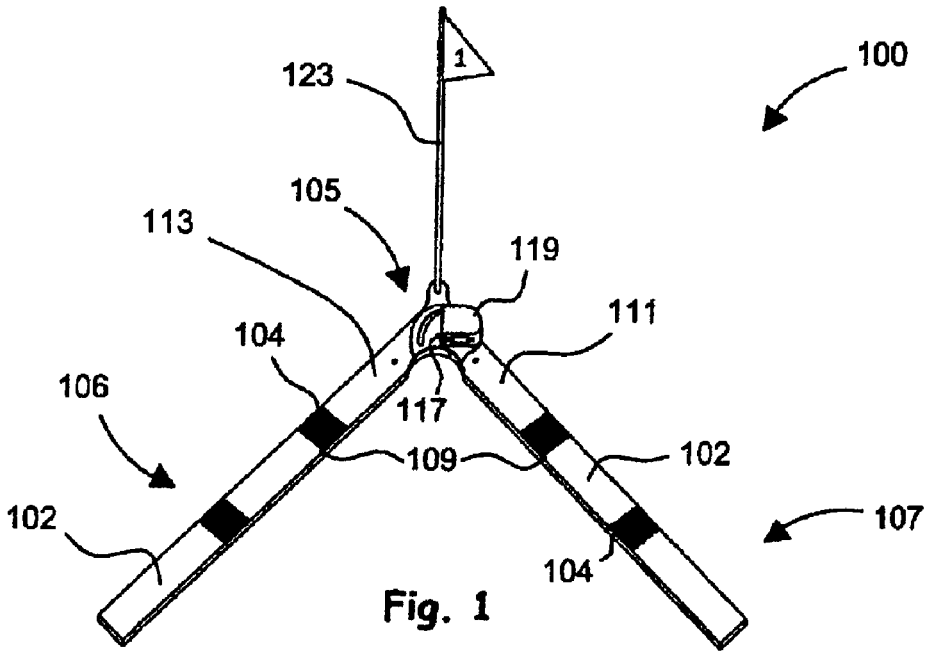
FIG. 1 is a perspective view of the apparatus.

Referring to the Figures, there is shown a perspective view of the apparatus of the present invention, generally designated 100.

In this example the apparatus 100 consists of four substantially rigid elongate members 102, two of which form a first arm 106 and two of which form a second arm 107. The elongate members 102 in the current example are of rectangular cross-section however, other form of construction may well be utilized without departing from the scope of the invention.

The elongate members 102 of arm 106 are fixed together by a hinging means 104 which when operated allows the elongate members 102 to lie one on top of the other. The hinging means 104 may be any commonly available hinge allowing for approximately 180 degrees of rotation. The elongate members 102 of arm 107 are similarly fixed to those of arm 106.

A hingable connecting member 105 is included in apparatus 100 and is hingedly fixed to ends 109 of the arms 106, 107 by a further hinging means 104. Any commonly available hinge allowing for approximately 180 degrees of rotation again achieves the connection between the connecting member 105 and the ends 109 of the arms 106, 107.

The connecting member 105 is comprised of an upper member 111 and a lower member 113 pivotally connected, one to the other by a bearing 115 in the form of a pin 117. The upper and lower members 111, 113 are of substantially similar cross section to that of the elongate members 102. The upper member 111 is further provided with a measuring means 119 for measuring distance, which is removably fixed in position such that when the apparatus 100 is in use a distance between a golf ball and a hole may be measured to provide the user with precise information thereby allowing him to adjust the weight of his stroke/shot accordingly.

Connecting member 104 includes an orifice 121 through which a flagpole 123 extends to provide the user with an additional focal point.

In use the apparatus 100 is placed on a surface such as a putting green with its arms 106, 107 fully extended as can be seen in FIG. 1. This provides the user with an easily recognizable focal point at which to aim their stroke/shot.

Figure 2:
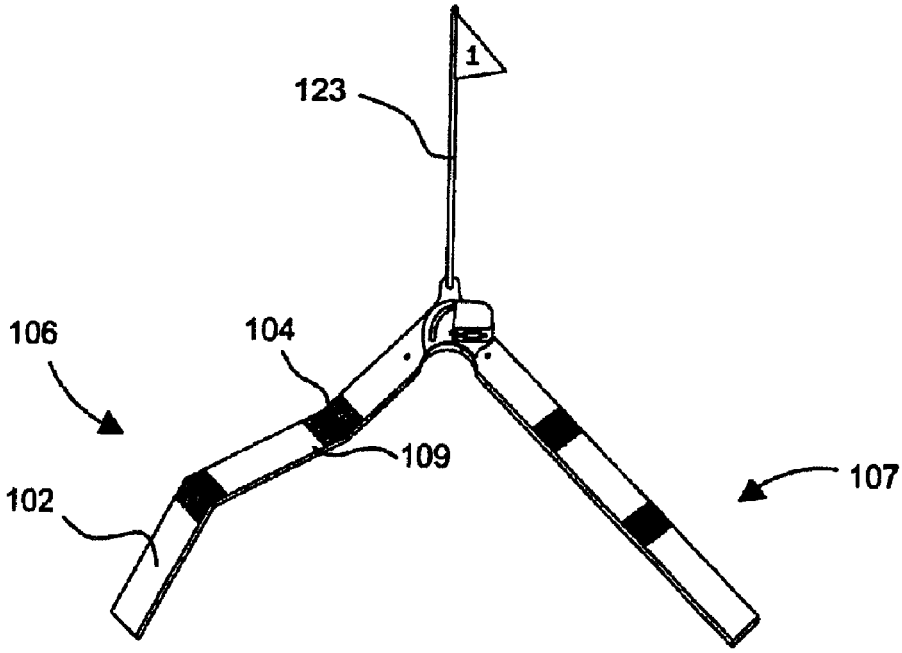
FIG. 2 is a perspective view of the apparatus shown in FIG. 1 wherein the an arm is being folded.

Referring now to FIGS. 1 and 2, as the user becomes more proficient at striking the golf ball in the desired direction can reduce the length of the arms 106, 107 by rotating the elongate members 102 furthermost from the connecting member 105 about the hinging means 104 furthermost from the connecting member 105 by approximately 180 degrees in order that the respective elongate members 102 of the arms 106, 107 sit upon each other. In thus configuring the apparatus 100 the user is, over time reducing their dependence on the apparatus 100 and improving the accuracy of their putting strokes or chip shots.

Figure 3:
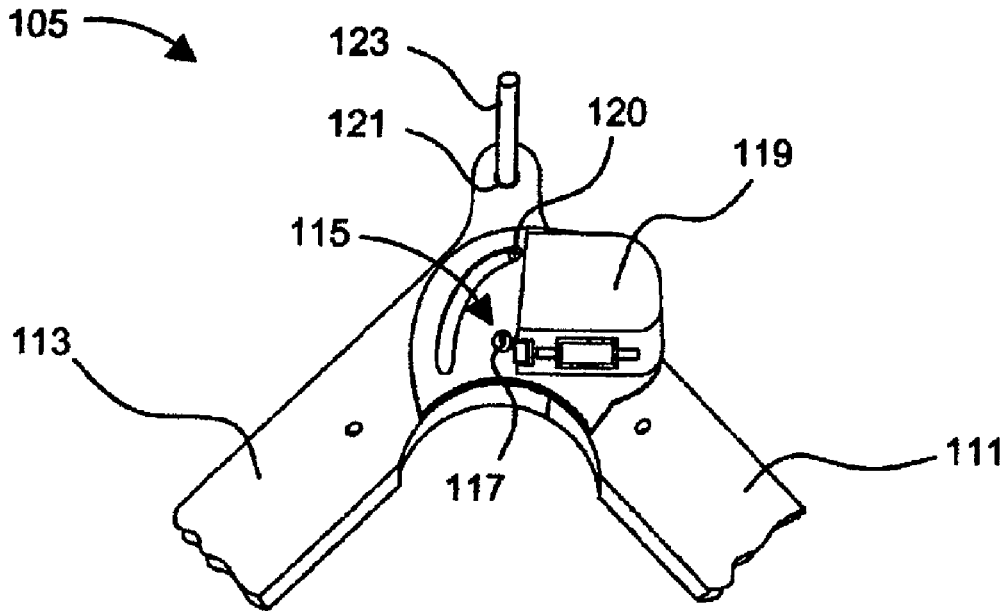
FIG. 3 is an enlarged view of the apparatus shown in FIG. 1.

Referring now to FIG. 3, which shows an enlarged view of the connecting member 105 of the apparatus 100. The angle can be altered to suit the requirements of the user. This is achieved by pivoting each arm 106, 107 about the pin 117. Locking pin 120 is inserted through corresponding holes in the upper and lower members 111, 113 in order to prevent the angle between the arms 106, 107 from being altered unintentionally.

Figure 4:
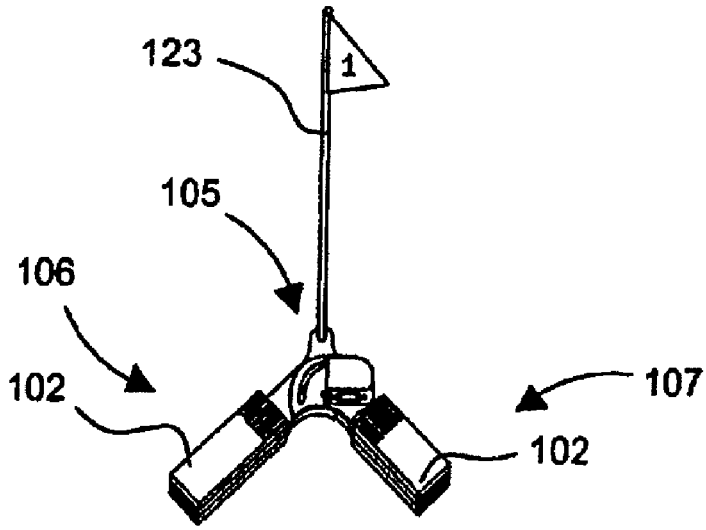
FIG. 4 is a perspective view of the apparatus shown in FIG. 1 wherein the arms have been fully folded.
Figure 5:
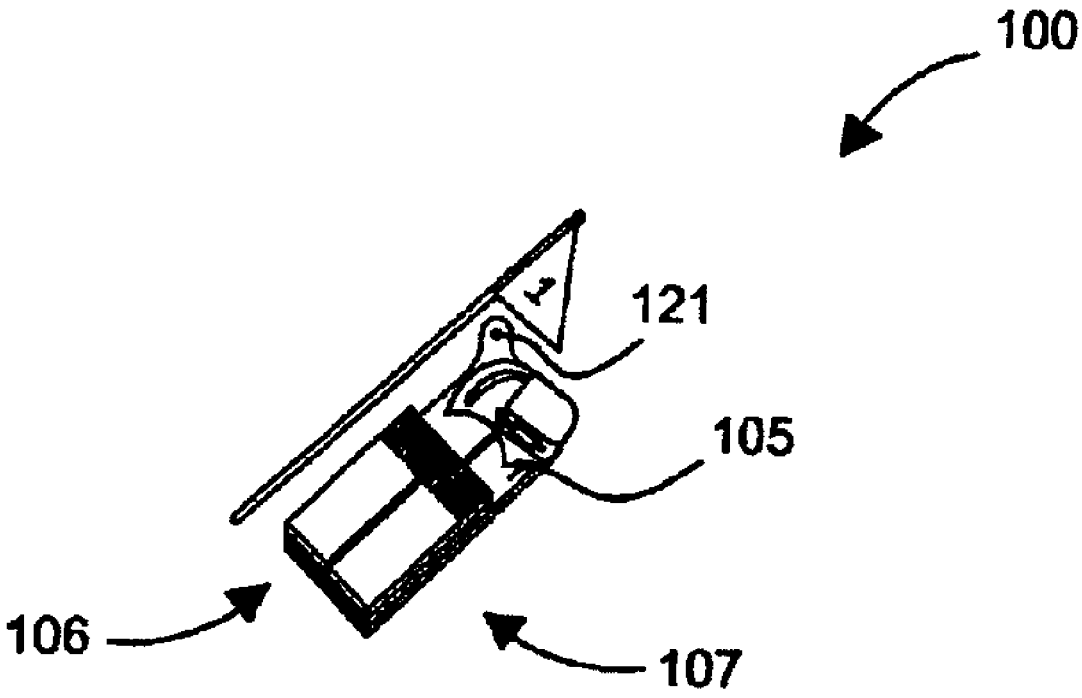
FIG. 5 is a perspective view of the apparatus shown in FIG. 1 wherein the apparatus has been folded for stowing.

FIG. 4 shows the apparatus 100 having had its elongate members 102 rotated about the hinging means 104 and the end 109 of the arms 106, 107 and the hinging means 104 between the elongate members 102. Thus configured, the apparatus 100 provides the user with a reduced target area from which they can progress to putting without the use of the apparatus 100.

When the apparatus 100 is no longer required the arms 106, 107 are simply folded as shown in FIG. 4 and the upper and lower members 111, 113 of the connecting member 105 are pivoted about the pin 117 to bring the arms 106, 107 together for easy stowing in for example, a golf bag.

The measuring means 119 is removably attached to the upper member 111 and so can be removed and replaced with a chalk line which allows the user to indicate the correct line to the hole. Alternatively, the chalk line may have its own separate mounting means provided at the upper member 111.

The invention in which an exclusive property or privilege is claimed is defined as follows:

1. A golf target apparatus for improving a golfer's technique, the apparatus comprising:

first and second hingable arms hingedly connected to a connecting member;

a bearing connecting upper and lower members of the connecting member, wherein the first and second arms are rotatable about the bearing between an in use position, wherein the first and second arms are angled away from each other, and a stored position, wherein the first and second arms are disposed generally parallel to each other; and wherein, when the first and second arms are in the in use position thereof, the area between the first and second arms defines a golf ball target area and the connecting member defines a focal point for aiming a golf shot positioned between the first and second arms, the focal point being in the form of a recess defined in a surface of the connecting member, the recess opening outwardly toward the target area.

2. The apparatus according to claim 1, wherein the length of each first and second arm is reducible to reduce the size of the target area.

3. The apparatus according to claim 2, wherein each first and second arm comprises a plurality of hingedly connected elongate members which are rotatable to reduce the size of the target area.

4. The apparatus of according to claim 1, wherein the focal point is in the form of a semi-circular recess.

5. The apparatus according to claim 1, wherein said connecting member includes an orifice for securely housing a flagpole.

6. The apparatus according to claim 2, wherein said connecting member is provided with a means for measuring a distance between the focal point and a golf ball.

7. The apparatus according to claim 1, wherein said hinged connection is capable of approximately 180 degrees of rotation.

8. The apparatus according to claim 1, wherein said bearing is a pin.

9. The apparatus according to claim 2, wherein said bearing is a pin.

10. The apparatus according to claim 3, wherein said bearing is a pin.

11. The apparatus according to claim 4, wherein said bearing is a pin.

12. The apparatus according to claim 5, wherein said bearing is a pin.

13. The apparatus according to claim 6, wherein said bearing is a pin.

14. The apparatus according to claim 7, wherein said bearing is a pin.

15. The apparatus according to claim 2, wherein a tape measure is provided on the connecting member, the tape measure capable of measuring a distance between the focal point and a golf ball.

16. The apparatus according to claim 15, wherein the tape measure is removably attached to the connecting member.

17. The apparatus according to claim 15, wherein a chalk line is provided on the connecting member.

18. The apparatus according to claim 17, wherein the chalk line is removably attached to the connecting member.

19. A golf target apparatus for improving a golfer's technique, the apparatus comprising:

first and second hingable arms hingedly connected to a connecting member;

a bearing connecting upper and lower members of the connecting member, wherein the first and second arms are rotatable about the bearing between an in use position, wherein the first and second arms are angled away from each other, and a stored position, wherein the first and second arms are disposed generally parallel to each other;

wherein, when the first and second arms are in the in use position thereof, the area between the first and second arms defines a golf ball target area and the connecting member defines a focal point for aiming a golf shot positioned between the first and second arms, the focal point being in the form of a recess opening outwardly toward the target area; and wherein the focal point is in the form of a semi-circular recess.

20. A golf target apparatus for improving a golfer's technique, the apparatus comprising:

first and second hingable arms hingedly connected to a connecting member;

a bearing connecting upper and lower members of the connecting member, wherein the first and second arms are rotatable about the bearing between an in use position, wherein the first and second arms are angled away from each other, and a stored position, wherein the first and second arms are disposed generally parallel to each other;

wherein, when the first and second arms are in the in use position thereof, the area between the first and second arms defines a golf ball target area and the connecting member defines a focal point for aiming a golf shot positioned between the first and second arms, the focal point being in the form of a semi-circular recess opening outwardly toward the target area; and wherein said bearing is a pin.

* * * * *